US007957690B2

(12) United States Patent
Baek et al.

(10) Patent No.: US 7,957,690 B2
(45) Date of Patent: Jun. 7, 2011

(54) IMAGE FORMING APPARATUS

(75) Inventors: Jung-gee Baek, Busan (KR); Dong-woo Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/385,624

(22) Filed: Apr. 14, 2009

(65) Prior Publication Data

US 2009/0202282 A1 Aug. 13, 2009

Related U.S. Application Data

(63) Continuation of application No. 11/481,259, filed on May 5, 2006, now Pat. No. 7,577,395, which is a continuation of application No. 10/425,641, filed on Apr. 30, 2003, now Pat. No. 7,079,806.

(30) Foreign Application Priority Data

Jul. 26, 2002 (KR) ..... 2002-44252

(51) Int. Cl.
*G03G 15/00* (2006.01)
*B65H 29/00* (2006.01)
*B65H 31/00* (2006.01)

(52) U.S. Cl. ..... 399/405; 399/361; 399/381; 271/207

(58) Field of Classification Search ..... 399/405, 399/361, 381, 388, 397, 124, 297, 315, 316–317; 271/278, 279, 287–292, 301, 207, 65, 184, 271/185; *G03G 15/00; B65H 29/52, 31/26, B65H 13/10*

See application file for complete search history.

(56) References Cited

U.S. PATENT DOCUMENTS 6,553,207 B2 * 4/2003 Tsusaka et al. ..... 399/401
7,079,806 B2 7/2006 Baek et al. ..... 399/405

FOREIGN PATENT DOCUMENTS

JP 63196453 A * 8/1988
JP 1-197270 8/1989
JP 4-117861 10/1992
JP 05-051160 3/1993

(Continued)

OTHER PUBLICATIONS

U.S. Appl. No. 11/418,259, filed May 5, 2006, Jung-gee Baek.

(Continued)

*Primary Examiner* — Judy Nguyen
*Assistant Examiner* — 'Wyn' Q Ha
(74) *Attorney, Agent, or Firm* — Staas & Halsey LLP

(57) ABSTRACT

An image forming apparatus includes a printer body having a developing portion and a fixing portion therein; a plurality of sheet feeding rollers successively disposed along a sheet discharge path of the printer body and driven to discharge a sheet from fixing portion to an upper portion of the printer body; and a rear cover portion having a rear cover provided on a side of the printer body to open and close, a guide rib member to guide the sheet from the fixing portion, an idle roller to rotate in contact with one of the sheet feeding rollers to feed the sheet, and a supplementary guide member to change a position thereof when the rear cover is open to prevent the sheet being discharged to the guide rib member from running into the idle roller.

14 Claims, 5 Drawing Sheets

FOREIGN PATENT DOCUMENTS

| | | |
|---|---|---|
| JP | 8-208095 | 8/1996 |
| JP | 62-083976 | 4/1997 |
| JP | 9-328249 | 12/1997 |
| JP | 10-297811 | 11/1998 |
| JP | 11-130311 | 5/1999 |

OTHER PUBLICATIONS

U.S. Appl. No. 10/425,641, filed Apr. 30, 2003, Jung-gee Baek.
U.S. Office Action dated Mar. 22, 2007, issued in the file history of U.S. Appl. No. 11/418,259.
U.S. Office Action dated Sep. 27, 2007, issued in the file history of U.S. Appl. No. 11/418,259.
U.S. Final Office Action dated Jan. 30, 2008, issued in the file history of U.S. Appl. No. 11/418,259.
U.S. Office Action dated Aug. 1, 2008, issued in the file history of U.S. Appl. No. 11/418,259.
U.S. Final Office Action dated Jan. 16, 2009, issued in the file history of U.S. Appl. No. 11/418,259.
U.S. Notice of Allowance dated Apr. 7, 2009, issued in the file history of U.S. Appl. No. 11/418,259.
U.S. Notice of Allowance dated Nov. 24, 2003, issued in the file history of U.S. Appl. No. 10/425,641.
U.S. Supplemental Notice of Allowance dated Mar. 8, 2005, issued in the file history of U.S. Appl. No. 10/425,641.

* cited by examiner

IMAGE FORMING APPARATUS

CROSS REFERENCE TO RELATED APPLICATIONS

This application is a continuation of application Ser. No. 11/418,259, filed May 5, 2006 now U.S. Pat. No. 7,577,395, which is a continuation of application Ser. No. 10/425,641, filed Apr. 30, 2003, which has issued as U.S. Pat. No. 7,079, 806, which are herein incorporated by reference. This application further claims the benefit of Korean Application No. 200244252, filed Jul. 26, 2002, in the Korean Intellectual Property Office, the disclosure of which is incorporated herein by reference.

BACKGROUND OF THE INVENTION

1. Field of the Invention

The present invention relates to an image forming apparatus and, more particularly, to an image forming apparatus to prevent sheets from running into an idle roller during a discharge of special sheets.

2. Description of the Related Art

Referring to FIG. 1, a conventional image forming apparatus is provided with a sheet supply cassette 11 in which sheets are stacked on a lower end of a body 10. The sheets in the sheet supply cassette 11 are picked up one after another by a pickup roller 12. The picked up sheets are sent to a developing portion 13. The developing portion 13 includes a photosensitive drum 14, a developing roller 15 and a transfer roller 16. The photosensitive drum 14 is charged with an electric potential by a charging device, and an electrostatic latent image corresponding to a predetermined image is formed on a charged surface by light scanned from a laser scanning unit 17. The electrostatic latent image area is fed with toner supplied by the developing roller 15. Accordingly, an image is formed and then transferred to and printed on a sheet passing between the photosensitive drum 14 and the transfer roller 16.

The sheet with the printed image is fixed at an elevated temperature and under a high pressure through a fixing portion 18, so that the toner image is fused thereonto. After passing through the fixing portion 18, the sheet passes through first, second and third sheet feeding rollers 21, 22 and 23 one after another, and is then stacked on a sheet stacking surface 10*a* provided on an upper section of the body 10. First, second and third idle rollers 24, 25 and 26 are further provided to rotatably contact with the sheet feeding rollers 21, 22 and 23, respectively, and thus rotate together to pass the sheet.

To print on both sides of the sheet, after passing the first or second sheet feeding roller 21 or 22, the sheet is reversed and directed through a duplex feeding path 30 to be fed again.

When a special sheet like an envelope, OHP film, etc., is printed by the above image forming apparatus, the sheet is discharged from the body 10 right after being passed through the first sheet feeding roller 21 in order to reduce an occurrence of a jam, curl, etc. Here, the second sheet feeding roller 22 and the second idle roller 25 are not used for sheet feeding. In other words, during special sheet printing, a rear cover 19 of the body 10 is opened with an angle from about 40° to 60°, as shown in FIG. 1. Then, the sheet is stacked on an inner guiding ribbed-surface 19*a* of the rear cover 19.

In the above-described construction, the second idle roller 25 protrudes higher than the guiding ribbed-surface 19*a*. Therefore, during the stacking of a sheet discharged from the body 10, there is a possibility that a leading end of the sheet may run into the idle roller 25, and thus change direction. Furthermore, there may be difficulty in stacking sheets due to sheet bending.

SUMMARY OF THE INVENTION

Accordingly, it is an aspect of the present invention to provide an improved image forming apparatus to prevent sheets from running into an idle roller during discharge of special sheets.

Additional aspects and advantages of the invention will be set forth in part in the description which follows and, in part, will be obvious from the description, or may be learned by practice of the invention.

The foregoing and/or other aspects of the present invention are achieved by providing an image forming apparatus including a printer body having a developing portion and a fixing portion therein; a plurality of sheet feeding rollers successively disposed along a sheet discharge path of the printer body and driven to discharge a sheet from fixing portion to an upper portion of the printer body; and a rear cover portion having a rear cover provided on a side of the printer body to open and close, a guide rib member to guide the sheet from the fixing portion, an idle roller to rotate in contact with one of the sheet feeding rollers to feed the sheet, and a supplementary guide member to change a position thereof when the rear cover is open to prevent the sheet being discharged to the guide rib member from running into the idle roller.

According to an aspect of the invention, each of the guide rib member and the idle roller has an open position and a closed position thereof with respect to the printer body corresponding to the rear cover being open or closed, so as to provide the sheet from the fixing portion to the upper portion of the printer body in response to the rear cover being closed and to the side of the printer body in response to the rear cover being open.

According to an aspect of the invention, wherein the guide rib member is disposed at an inner side of the rear cover.

According to an aspect of the invention, wherein the guide rib member comprises a plurality of guide ribs.

According to an aspect of the invention, wherein the guide ribs are disposed at an inner side of the rear cover and the supplementary guide member is disposed between the guide ribs.

According to an aspect of the invention, wherein the idle roller is movably disposed at the rear cover.

According to an aspect of the invention, wherein the idle roller rotates in contact with the one of the sheet feeding rollers to feed the sheet where the rear cover is closed.

According to an aspect of the invention, wherein the supplementary guide member is disposed between the side of the printer body and the rear cover.

According to an aspect of the invention, wherein the supplementary guide member is pivotably disposed between the side of the printer body and the rear cover.

According to an aspect of the invention, wherein the supplementary guide member is pivotably disposed at the rear cover.

According to an aspect of the invention, wherein the supplementary guide member is pivotably disposed at the guide rib member.

The foregoing and/or other aspects of the present invention are achieved by providing an image forming apparatus including a body defining an exterior portion of the image forming apparatus; and a rear cover portion having a rear cover provided on a side of the body to open and close, a guide rib member to guide a sheet passing through a portion of the body, an idle roller to rotate as the sheet is discharged to an upper portion of the body, and a supplementary guide member, to change a position thereof when the rear cover is open, preventing the sheet being discharged to the guide rib member from running into the idle roller.

The foregoing and/or other aspects of the present invention are achieved by providing an image forming apparatus including a printer body having a developing portion and a fixing portion therein; a plurality of sheet feeding rollers successively disposed along a sheet discharge path of the printer body and driven to discharge a sheet from the fixing portion to an upper portion of the printer body; a rear cover provided on a side of the printer body to open and close; a guide rib member to guide the sheet from the fixing portion; an idle roller to rotate in contact with one of the sheet feeding rollers to feed the sheet where the rear cover is closed; and a supplementary guide member having a position corresponding to the rear cover being open to guide the sheet being discharged to the guide rib member.

According to an aspect of the invention, the supplementary guide member changes a position thereof when the rear cover is open.

According to an aspect of the invention, the supplementary guide member changes a position thereof when the rear cover is open so that an upper end of the supplementary guide member is moved to a position that extends as far as or farther than the idle roller.

According to an aspect of the invention, the supplementary guide member changes a position thereof when the rear cover is open so that an upper end of the supplementary guide member protrudes beyond a guide surface of the guide rib member.

According to an aspect of the invention, the supplementary guide member changes a position thereof when the rear cover is open so that a leading edge of the sheet being discharged contacts a guide surface of the supplementary guide member to be guided pass the supplementary guide member as it passes the idle roller.

According to an aspect of the invention, each of the guide rib member and the idle roller has an open position and a closed position thereof with respect to the printer body corresponding to the rear cover being open or closed, so as to provide the sheet from the fixing portion to the upper portion of the printer body in response to the rear cover being closed and to the side of the printer body in response to the rear cover being open.

According to an aspect of the invention, the guide rib member is disposed at an inner side of the rear cover.

According to an aspect of the invention, the idle roller is movably disposed at the rear cover.

According to an aspect of the invention, the supplementary guide member is disposed between the side of the printer body and the rear cover.

According to an aspect of the invention, the supplementary guide member is pivotably disposed at the rear cover.

According to an aspect of the invention, the supplementary guide member is pivotably disposed at the guide rib member.

The foregoing and/or other aspects of the present invention are achieved by providing an image forming apparatus including a body defining an exterior portion of the image forming apparatus; a rear cover provided on a side of the body to open and close; a guide rib member to guide a sheet passing through a portion of the printer body; an idle roller to rotate as the sheet is discharged to an upper portion of the body; and a supplementary guide member having a position corresponding to the rear cover being open to guide the sheet being discharged to the guide rib member.

According to an aspect of the invention, each of the guide rib member and the idle roller has an open position and a closed position thereof with respect to the body corresponding to the rear cover being open or closed, so as to provide the sheet from the portion to the upper portion of the printer body in response to the rear cover being closed and to the side of the printer body in response to the rear cover being open.

According to an aspect of the invention, the supplementary guide member changes a position thereof when the rear cover is open so that an upper end of the supplementary guide member is moved to a position that extends as far as or farther than the idle roller.

According to an aspect of the invention, the supplementary guide member changes a position thereof when the rear cover is open so that an upper end of the supplementary guide member protrudes beyond a guide surface of the guide rib member.

According to an aspect of the invention, the supplementary guide member changes a position thereof when the rear cover is open so that a leading edge of the sheet being discharged contacts a guide surface of the supplementary guide member to be guided pass the supplementary guide member as it passes the idle roller

BRIEF DESCRIPTION OF THE DRAWINGS

The above and/or other aspects and advantages of the present invention will become apparent and more appreciated from the following detailed description of the preferred embodiments, taken in conjunction with the accompanying drawings of which.

DETAILED DESCRIPTION OF THE PREFERRED EMBODIMENTS

Figure 1:
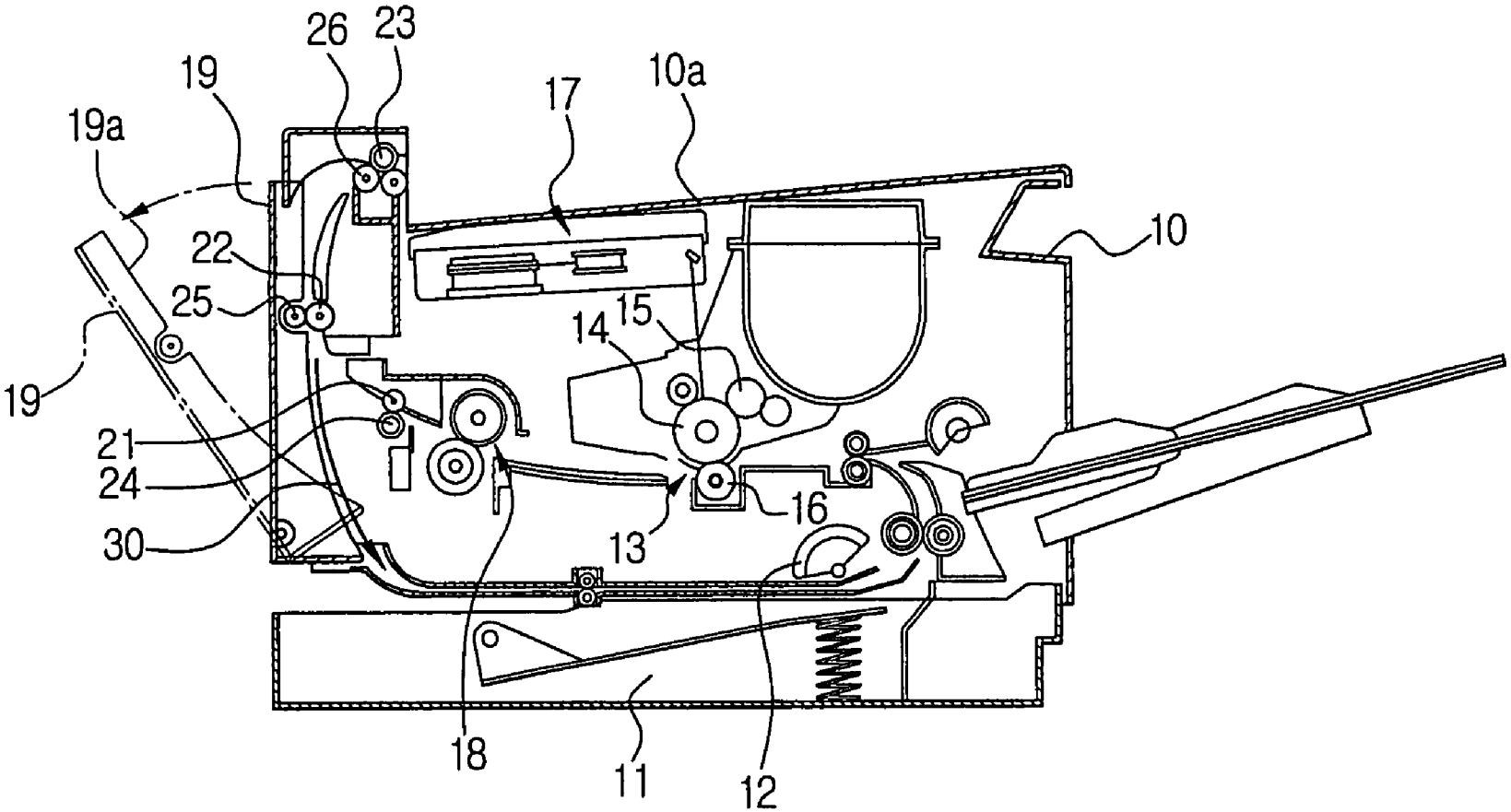
FIG. 1 (PRIOR ART)
FIG. 1 is a schematic diagram showing a conventional image forming apparatus.

Reference will now be made in detail to the present preferred embodiments of the present invention, examples of which are illustrated in the accompanying drawings, wherein like reference numerals refer to like elements throughout.

Figure 2:
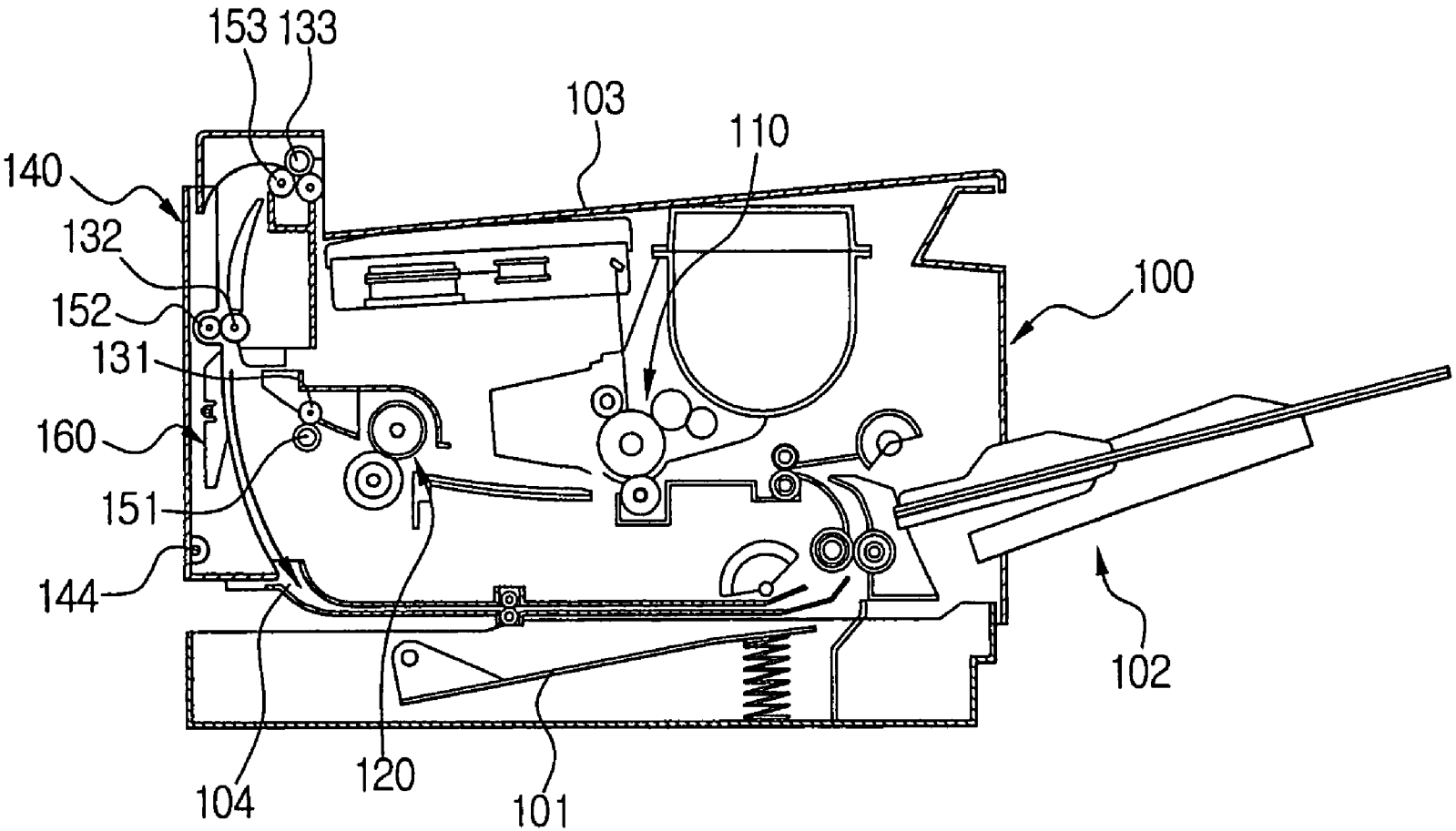
FIG. 2 is a schematic diagram showing an image forming apparatus, according to an embodiment of the present invention.
Figure 3:
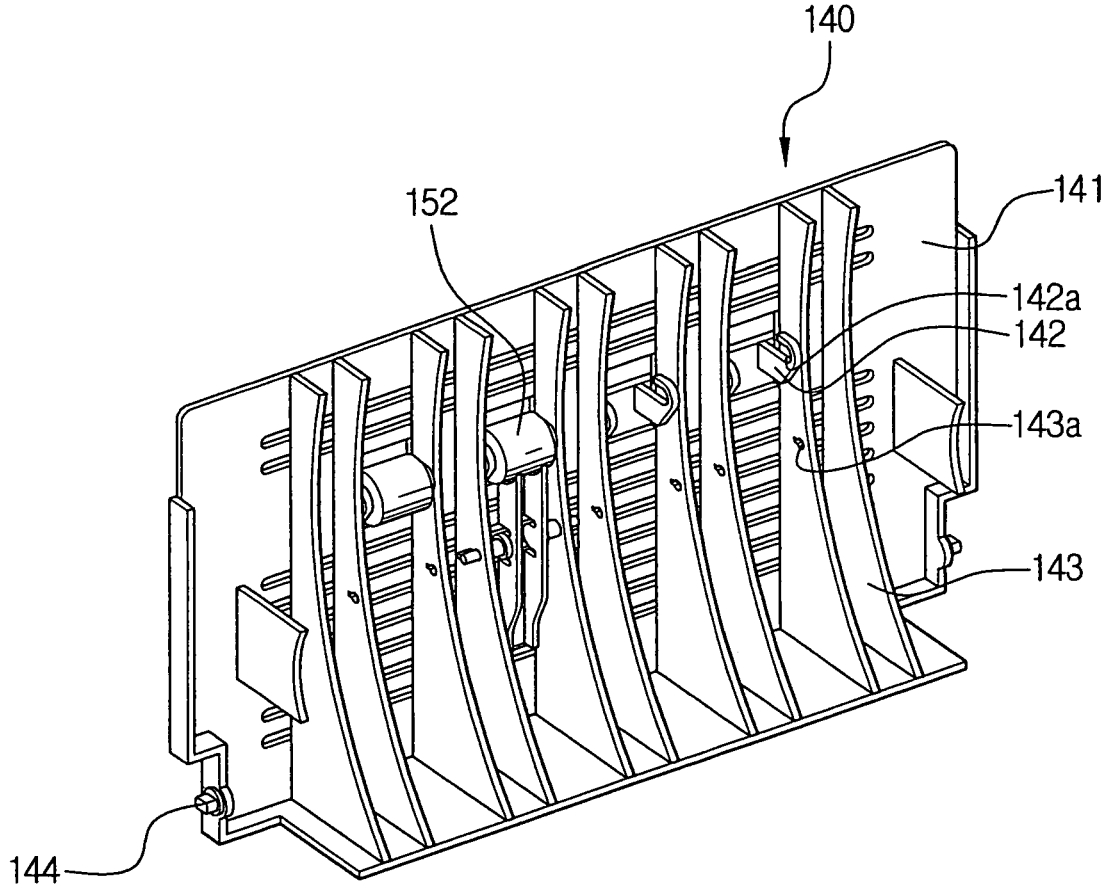
FIG. 3 is a perspective view of a rear cover in FIG. 2.

Referring to FIG. 2, an image forming apparatus, according to an embodiment of the present invention includes a printer body 100 provided with a developing portion 110 and a fixing portion 120 disposed therein, a plurality of sheet feeding rollers 131, 132 and 133, a rear cover 140 disposed at a rear side of the printer body 100 to open and close, an idle roller 152 rotatably disposed at the rear cover 140, and a supplementary guide member 160 rotatably disposed at the rear cover 140.

The printer body 100 is provided with a sheet supply cassette 101 disposed at a lower part thereof, and a manual sheet supply portion 102 disposed at a front side thereof. Since the constitutions of the developing portion 110 and the fixing portion 120 are identical to those of the developing portion 13 and the fixing portion 18 as described in FIG. 1 above, respectively, a detailed description thereof will be omitted.

The printer body 100 is also provided with first, second and third sheet feeding rollers 131, 132 and 133 successively disposed to direct a sheet, after being passed through the fixing portion 120, to a stacking surface 103 provided on an upper portion of the printer body 100. Each of the sheet feeding rollers 131, 132 and 133 is driven to rotate by a predetermined driving source, and to forcibly feed the sheet. In other words, after passing through the fixing portion 120, the sheet passes through the first and second sheet feeding rollers 131 and 132 to be discharged to the stacking surface 103 by the third sheet feeding roller 133. Furthermore, the second and third sheet feeding rollers 132 and 133 may rotate reversely, in order to reverse the sheet passed out of the first sheet feeding roller 131. The reversed sheet is directed to a duplex feeding path 104, and supplied to the developing portion 110 again.

The sheet feeding rollers 131, 132 and 133 contact the first, second and third idle rollers 151, 152 and 153 to rotate, respectively. That is, the idle rollers 151, 152 and 153 contact the sheet feeding rollers 131, 132 and 133, respectively, at a predetermined pressure to rotate in order to feed the sheet. The first and third idle rollers 151 and 153 are disposed at the printer body 100, while the second idle roller 152 is rotatably disposed at the rear cover 140.

Figure 4:
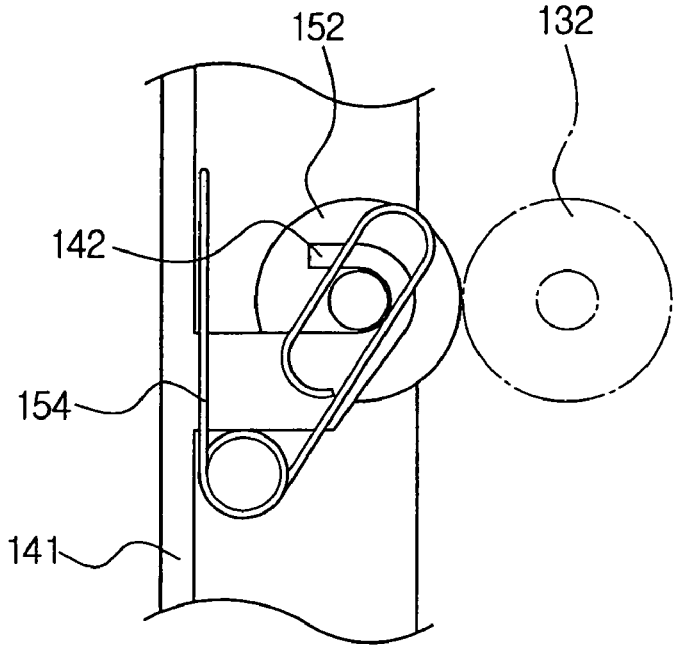
FIG. 4 is a schematic diagram showing a main part of FIG. 3.

The rear cover 140 is provided with supporting projections 142 having supporting slits 142*a* to movably support the idle roller 152. Thus, a rotation shaft of the idle roller 152 is fitted in the supporting slits 142*a* to enable the idler roller 152 to move. As shown in FIG. 4, a torsion spring 154 is interposed between a main panel 141 of the rear cover and the idle roller 152. The torsion spring 154 compresses the idle roller 152 elastically toward the second sheet feeding roller 132 to generate a predetermined friction force between the second sheet feeding roller 132 and the idle roller 152.

Furthermore, the rear cover 140 is provided with a plurality of sheet guide ribs 143 on an inner side of the main panel 141. The plurality of guide ribs 143 are disposed at a predetermined spacing. Guide surfaces of the guide ribs 143 are rounded to form curved surfaces so that the sheet is guided in a vertical direction. The rear cover 140 may pivot on a hinge shaft 144 at a predetermined angle, and preferably may be opened at an angle of 45° to 60°.

Meanwhile, when a special sheet like an envelope or an OHP film is printed, jams, curls, etc., are very likely to occur if the special sheet is discharged passed the second and third sheet feeding rollers 132 and 133. Therefore, by opening the rear cover 140, the special sheet may be stacked on the guide ribs 143 of the rear cover 140 right after passing the first sheet feeding roller 131. Thus, the rear cover 140 must be configured to open at a predetermined angle.

The supplementary guide member 160 is provided to prevent the special sheet from running into the idle roller 152 when the special sheet is stacked on the opened rear cover 140. The supplementary guide member 160 is positioned below the idle roller 152. Moreover, the supplementary guide member 160 is interposed between guide ribs 143 of the rear cover 140, and is pivotably fitted in and supported by supporting holes 143*a* formed in the guide ribs 143.

Figure 5:
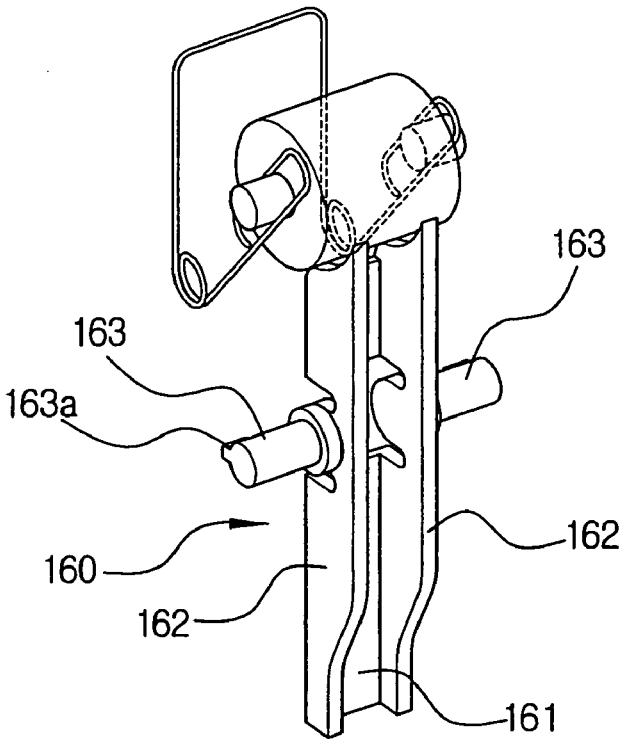
FIG. 5 is a perspective view showing a supplementary guide member as shown in FIG. 3.
Figure 6:
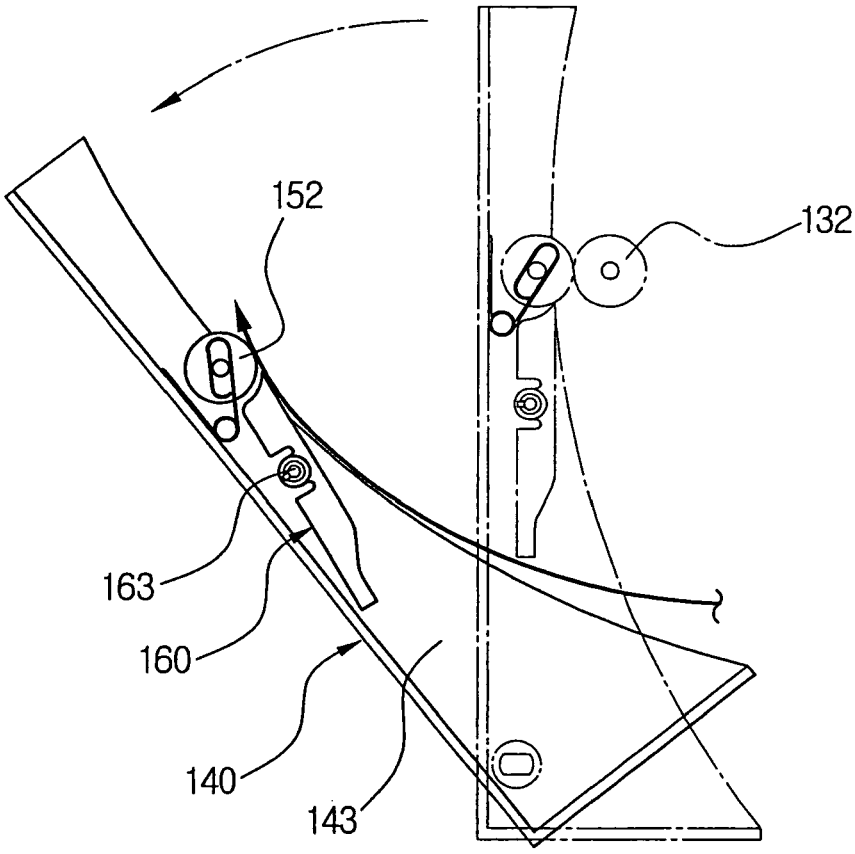
FIG. 6 is a diagram showing the rear cover of FIG. 2 in an opened state.

Referring to FIG. 5, the supplementary guide member 160 includes a plate-shaped body 161 to face the main panel 141 of the rear cover 140, a pair of wings 162 extended from both edges of the plate-shaped body 161 in a vertical direction, and rotation shafts 163 to coaxially protrude from outer sides of the pair of wings 162. The wings 162 are aligned with the guide ribs 143, and function to guide the discharged special sheet. The rotation shafts 163 are eccentrically positioned relative to a center of an entire length of the supplementary guide member 160. That is, the rotation shafts 163 are eccentrically positioned above the center of a vertical length of the supplementary guide member 160. Therefore, a center of gravity of the supplementary guide member 160 is located in a lower portion of the supplementary guide member from the rotation shafts 163. Accordingly, when the rear cover 140 is pivoted at an angle as shown in FIG. 6, the supplementary guide member 160 is pivoted clockwise due to its own weight on the rotation shafts 163. Accordingly, the supplementary guide member 160 changes its position so that its upper end protrudes higher than the guide rib 143, and therefore higher than the idle roller 152 relative to a surface of the main panel 141.

Figure 7:
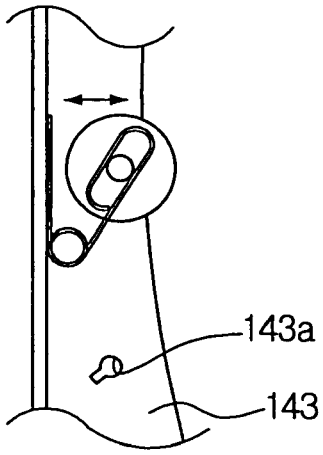
FIG. 7 is a view showing a main portion of the rear cover of FIG. 3.

Furthermore, each of the rotation shafts 163 is provided on both ends thereof with latching projections 163*a* to protrude crosswise and preferably at an angle of 90° with respect to an axial direction of the rotation shaft 163. The latching projections 163*a* prevent separation of the rotation shaft 163 from the supporting holes 143*a* of the guide ribs 143. Therefore, the supporting holes 143*a* formed in the guide ribs 143 are not circular-shaped, but have shapes corresponding to those of the rotation shafts 163 and the latching projections 163*a*, as shown in FIG. 7.

Hereinafter, an operation of the image forming apparatus of the present invention will be described below.

As shown FIG. 2, the rear cover 140 maintains an upright position when it is not open. Here, the supplementary guide member 160 also maintains an upright position due to its own weight. Therefore, the upper end of the supplementary guide member 160 does not protrude beyond the idle roller 152 relative to the guide rib 143, and thus maintains a position at least parallel to the sheet guide surface of the guide rib 143. Here, none of the special sheets are printed. Accordingly, an ordinary printed sheet, after passing through the fixing portion 120, is guided by the first, second and third sheet feeding rollers 131, 132 and 133 successively, and is finally discharged to the upper portion of the printer body 100.

Furthermore, to print on both sides of a sheet, as soon as a trailing edge of the sheet passes through the first sheet feeding roller 131, the second and third sheet feeding rollers 132 and 133 reverse their rotating direction, so that the sheet is directed to the duplex feeding path 104 and then fed to the developing portion 110 again.

When a special sheet such as an envelope or an OHP film is printed, the rear cover 140 is pivoted as shown in FIG. 6, so that a side of the printer body 100 in which the rear cover 140 is positioned, is opened. Here, the rear cover 140 is opened at an angle from about 45° to 60°. As the rear cover 140 is opened to change its position, the supplementary guide member 160 is pivoted due to its own weight on the rotation shaft 163. Therefore, as shown in FIG. 6, the lower end of the supplementary guide member 160 hangs down and the upper end thereof protrudes upward. Then, the upper end of the supplementary guide member 160 protrudes beyond the guide surface of the guide rib 143, and thus the upper end of the supplementary guide member 160 is extended as far as or farther than the idle roller 152.

As printing is performed under the above-described conditions, the special sheet, after passing the first sheet feeding roller 131, is directly fed to an inner surface of the rear cover 140 outside of the printer body 100. A leading edge of the special sheet being discharged by the first sheet feeding roller 131 contacts the guide surface of the supplementary guide member 160 to be guided pass the supplementary guide member as it passes the idle roller 152, thereby being stacked on the rear cover 140. Therefore, as the discharged special sheet does not run into the idle roller 152 as in the prior art, the possibility of the special sheet being stacked in a non-aligned and irregular state is minimized.

As described above, according to the image forming apparatus of the present invention, a sheet discharge path is shortened by opening the rear cover during printing of a special sheet so that the special sheet or a plurality of special sheets are smoothly stacked. Moreover, as the supplementary guide member provided on the rear cover changes its position when the rear cover is open, a discharged special sheet is prevented from running into the idle roller, so that smooth stacking is accomplished.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a printer body having a developing portion and a fixing portion therein;

a plurality of sheet feeding rollers disposed within the printer body and driven to feed a sheet along a sheet feed path;

a rear cover provided on a side of the printer body, the rear cover movable between an opened state and a closed state;

a guide rib member disposed at an inner side of the rear cover to guide a sheet being fed along the sheet feed path;

an idle roller disposed at an inner side of the rear cover to rotatably contact one of the sheet feeding rollers to feed a sheet when the rear cover is in the closed state; and a supplementary guide member moveable between a first position when the rear cover is in the opened state and a second position when the rear cover is in the closed state, wherein, when the rear cover is in the opened state and the supplementary guide member is in the first position, at least a portion of the supplementary guide member is positioned above the idle roller provided on the rear cover corresponding to the rear cover being open to guide the sheet being discharged to the guide rib member, wherein, when the rear cover is in the closed state and the supplementary guide member is in the second position, all portions of the supplementary guide member are positioned on the side of the rear cover with respect to a common tangent line at a nip formed between the idle roller provided on the rear cover and a corresponding sheet feeding roller disposed within the printer body, and wherein the supplementary guide member prevents the sheet being discharged to the guide rib member from running into the idle roller when the rear cover is in the opened state.

2. The image forming apparatus of claim 1, wherein, when the rear cover is in the closed state and the supplementary guide member is in the second position, a top edge of the supplementary guide member is positioned below the idle roller provided on the rear cover such that a sheet to be fed along the guide rib member of the rear cover is guided into a nip formed between the idle roller provided on the rear cover and the corresponding sheet feeding roller disposed within the printer body.

3. The image forming apparatus of claim 1, wherein the supplementary guide member changes a position thereof when the rear cover is open so that an upper end of the supplementary guide member is moved to a position that extends above the idle roller.

4. The image forming apparatus of claim 1, wherein the supplementary guide member changes a position thereof when the rear cover is open so that an upper end of the supplementary guide member is positioned above a guide surface of the guide rib member.

5. The image forming apparatus of claim 1, wherein the supplementary guide member changes a position thereof when the rear cover is open so that a leading edge of the sheet being discharged contacts a guide surface of the supplementary guide member as the sheet passes the idle roller provided on the rear cover.

6. The image forming apparatus of claim 1, wherein each of the guide rib member and the idle roller has an open position and a closed position thereof with respect to the printer body corresponding to the rear cover being open or closed, so as to provide the sheet from the fixing portion to the upper portion of the printer body in response to the rear cover being closed and to the side of the printer body in response to the rear cover being open.

7. The image forming apparatus of claim 1, wherein the supplementary guide member is disposed adjacent to a rear side of the printer body and the rear cover.

8. The image forming apparatus of claim 1, wherein the supplementary guide member is pivotably disposed at the rear cover.

9. The image forming apparatus of claim 1, wherein the supplementary guide member is pivotably disposed adjacent to the guide rib member.

10. An image forming apparatus comprising:

a body defining an exterior portion of the image forming apparatus;

a rear cover provided on a side of the body to open and close the side of the body;

a guide rib member provided on the rear cover to guide a sheet passing through a portion of the printer body;

an idle roller provided on the rear cover to rotate as a sheet is fed along a duplex feeding path when the rear cover is closed; and a supplementary guide member movable between a first position and a second position, wherein, when the supplementary guide member is in the first position, at least a portion of the supplementary guide is raised relative to the idle roller so as to prevent a sheet being discharged from being skewed by the idle roller provided on the rear cover, and wherein, when the rear cover is in the closed state and the supplementary guide member is in the second position, all portions of the supplementary guide member are positioned on the side of the rear cover with respect to a common tangent line at a nip formed between the idle roller provided on the rear cover and a corresponding sheet feeding roller disposed within the printer body, and wherein the supplementary guide member prevents the sheet being discharged to the guide rib member from running into the idle roller when the rear cover is in the opened state.

11. The image forming apparatus of claim 10, wherein at least one of the guide rib member and the idle roller has an open position and a closed position thereof with respect to the body corresponding to the rear cover being open or closed.

12. The image forming apparatus of claim 10, wherein the supplementary guide member changes a position thereof when the rear cover is open such that at least a portion of the supplementary guide member is positioned above the idle roller.

13. The image forming apparatus of claim 10, wherein the supplementary guide member changes a position thereof when the rear cover is open such that at least a portion of the supplementary guide member is positioned above a guide surface of the guide rib member.

14. The image forming apparatus of claim 10, wherein the supplementary guide member changes a position thereof when the rear cover is open so that a leading edge of the sheet being discharged contacts a guide surface of the supplementary guide member as the sheet passes over the idle roller.

* * * * *

UNITED STATES PATENT AND TRADEMARK OFFICE

CERTIFICATE OF CORRECTION

PATENT NO. : 7,957,690 B2
APPLICATION NO. : 12/385624
DATED : June 7, 2011
INVENTOR(S) : Jung-gee Baek et al.

It is certified that error appears in the above-identified patent and that said Letters Patent is hereby corrected as shown below:

On the Title Page, Item (63) (Related U.S. Application Data), Line 1, Delete "11/481,259," and insert -- 11/418,259, --, therefor.

Column 1, Line 12, Delete "200244252" and insert -- 2002-44252, --, therefor.

Column 8, Line 50, In Claim 10, after "cover," delete "and".

Signed and Sealed this
Fourteenth Day of February, 2012

David J. Kappos

David J. Kappos
*Director of the United States Patent and Trademark Office*